US010851984B2

(12) United States Patent
Zhang et al.

(10) Patent No.: US 10,851,984 B2
(45) Date of Patent: Dec. 1, 2020

(54) SHOWCASE LAMP

(71) Applicants: Self Electronics Co., Ltd., Zhejiang (CN); Wanjiong Lin, Zhejiang (CN); Self electronics USA Corporation, Norcross, GA (US)

(72) Inventors: Chengke Zhang, Zhejiang (CN); Zuping He, Zhejiang (CN)

(73) Assignees: Wanjiong Lin, Ningbo (CN); Self Electronics Co., Ltd., Ningbo (CN); Self Electronics USA Corp., Norcross, GA (US)

( * ) Notice: Subject to any disclaimer, the term of this patent is extended or adjusted under 35 U.S.C. 154(b) by 0 days.

(21) Appl. No.: 16/442,195

(22) Filed: Jun. 14, 2019

(65) Prior Publication Data

US 2020/0003405 A1 Jan. 2, 2020

(30) Foreign Application Priority Data

Jul. 2, 2018 (CN) ..... 2018 1 0707750

(51) Int. Cl.

| | |
|---|---|
| ***F21V 27/00*** | (2006.01) |
| ***F21S 8/00*** | (2006.01) |
| ***F21V 15/01*** | (2006.01) |
| ***F21V 17/06*** | (2006.01) |
| ***F21V 17/12*** | (2006.01) |
| ***F21V 21/22*** | (2006.01) |
| ***F21V 23/06*** | (2006.01) |
| ***F21Y 103/10*** | (2016.01) |
| ***F21Y 115/10*** | (2016.01) |

(Continued)

(52) U.S. Cl.

CPC ..... *F21V 27/00* (2013.01); *F21S 8/00* (2013.01); *F21V 5/04* (2013.01); *F21V 15/01* (2013.01); *F21V 17/06* (2013.01); *F21V 17/12* (2013.01); *F21V 21/22* (2013.01); *F21V 23/06* (2013.01); *F21W 2131/405* (2013.01); *F21Y 2103/10* (2016.08); *F21Y 2115/10* (2016.08)

(58) Field of Classification Search

None

See application file for complete search history.

(56) References Cited

U.S. PATENT DOCUMENTS

2007/0195518 A1* 8/2007 Tanaka ..... F21V 19/008 362/125

2016/0195224 A1* 7/2016 Conley ..... F21K 9/20 362/219

(Continued)

*Primary Examiner* — Britt D Hanley

(74) *Attorney, Agent, or Firm* — Wang Law Firm, Inc.

(57) ABSTRACT

A showcase lamp includes a lamp body having a light-emitting module therein, and the lamp body is externally provided with a first terminal draw out from the light-emitting module; and at least one upright stanchion, the upper end of the upright stanchion supports the lamp body, and the lower end of the upright stanchion can be detachably fixed on the showcase to be installed; wherein the upright stanchion is a hollow rod, and the upper end of the at least one upright stanchion is provided with a second terminal for communicating with the first terminal, and the lower end of the upright stanchion is provided with a third terminal for connecting external power supply or for interconnecting with adjacent lamps, the upright stanchion is built-in with wires connecting the second terminal and the third terminal.

10 Claims, 13 Drawing Sheets

(51) Int. Cl.
*F21W 131/405* (2006.01)
*F21V 5/04* (2006.01)

(56) References Cited

U.S. PATENT DOCUMENTS

2019/0266929 A1* 8/2019 Beille ..... G09F 13/22
2019/0368720 A1* 12/2019 Xue ..... F21V 5/04

* cited by examiner

SHOWCASE LAMP

RELATED APPLICATION

This application claims priority to a Chinese Patent Application No. CN 201810707750.0, filed on Jul. 2, 2018.

FIELD OF THE TECHNOLOGY

The present invention relates to lighting technology field, with particular emphasis on a showcase lamp.

BACKGROUND OF THE INVENTION

In order to improve the brightness of the products placed in the showcase, the existing showcases will be provided with lights in the showcase. At present, the installation method of lamps in the showcases is to fix the lamp body directly at the top or side corner of the cabinet mostly through the installation seat of the housings of lamps or the installation wing plate at both ends of the lamps, and then lead out the wire to connect the external power supply.

This kind of showcase lamp also has certain deficiencies. On one hand, the wires used to connect the external power supply are exposed in the showcase, which affects the visual beauty of the showcase. To solve this problem, the showcase lamps often have the power supply built into the lamp body. Although the lamp with built-in power supply can connect the external power supply without the wire leading out, but it also increased its weight and volume, and it is not easy to install and occupies a bigger space, then it is very eye-catching in the showcase, which does not meet people's demand for transparent and visual space of the showcase. On the other hand, the existing showcase lamps can only be fixed at the top or corners of the cabinet. Due to the limitation of the installation position of the showcase, it is often unable to achieve the best illumination angle and effect, and because of the fixed position problem of lamps, part of the light can scatter outside the showcase and shine on the height of human eyes, causing glare interference. This kind of lamp cannot meet the lighting requirements of different specifications of the showcase.

Therefore, the existing showcase lamps need further improvement.

BRIEF SUMMARY OF THE INVENTION

The technical problem to be solved by the present invention is to provide a showcase lamp capable of concealing wires for external power source, which is small and beautiful, and has a good lighting effect, in view of the current state of the art.

The technical solution adopted by the present invention to solve the above technical problems is: a showcase lamp comprising: a lamp body having a light-emitting module therein, and the lamp body is externally provided with a first terminal draw out from the light-emitting module; and at least one upright stanchion, the upper end of the upright stanchion supports the lamp body, and the lower end of the upright stanchion can be detachably fixed on the showcase to be installed; wherein the upright stanchion is a hollow rod, and the upper end of the at least one upright stanchion is provided with a second terminal for communicating with the first terminal, and the lower end of the upright stanchion is provided with a third terminal for connecting external power supply or for interconnecting with adjacent lamps, the upright stanchion is built-in with wires connecting the second terminal and the third terminal.

Advantageously, the lamp body is detachably mounted on the upper end of the upright stanchions; when the lamp body is mounted to the upper end of the upright stanchions, the first terminal is in communication with the second terminal; when the lamp body is disengaged from the upper end of the upright stanchions, the first terminal is disconnected from the second terminal. On one hand, it is convenient to disassemble and assemble with less space and convenient to pack and transport. On the other hand, when this kind of lamps is used inside cabinet, it is convenient to put the lamp body on the upright stanchion or take down from the upright stanchion, and it is convenient to change lamp body fast.

Advantageously, the lamp body has an elongated shape, and the first terminal is drawn from at least one end of the lamp body; the upright stanchions are two, respectively supported and connected at both ends of the lamp body. The stability of this kind of lamp body structure is good; the length of the strip lamp body can be selected according to the specifications, size of the display cabinet, thus meeting the light needs of many products in the display cabinet.

Advantageously, the showcase lamp further comprising an adapter for connecting the lamp body and the upright stanchions, the adapter having a first end connectable to an end of the lamp body, and a second end mounted on the upper end of the upright stanchions; the upper end of the upright stanchion has a sleeve, and the second end of the adapter is detachably inserted into the sleeve. The detachable connection mode can conveniently place the lamp body on the upright stanchion or remove the lamp body from the upright stanchion and replace the lamp body quickly and conveniently.

Advantageously, the at least one adapter is a hollow pipe fittings connected from the first end through to the second end, and the first terminal is disposed in the tube cavity of the second ends of the adapter, the wiring of the light-emitting module, which is connected to the inside of the lamp body, passes through the tube cavity to connect the first terminal; the sleeve of the at least one upright stanchion is provided with the second terminal, and correspondingly, the first terminal can move with the adapter and plug into and connect the second terminal. The upper end of this upright stanchion adopts the way of sleeve and adapter inserting and matching. Its structure is simple, and the second terminal inside it can be accurately connected with the first terminal inside the pipe mouth of the second end of adapter.

Advantageously, the first end of the adapter is arranged perpendicular to the second end. This configuration makes the lamp body more stable when placed on the upright stanchion.

Advantageously, the lower end of the upright stanchions has a clamping member for fastening the upright stanchions to the showcase to be mounted; the clamping member includes a threaded through tube with external thread and a precession nut sleeved on the threaded through tube, and the threaded through tube is provided with a resisting portion which clamping fits the precession nut. This structure is set so that the upright stanchion can be fixed on the display cabinet stably. During the installation, just pass the pipe through the installation hole on the display cabinet and then tighten the precession nut to complete the fixed installation.

Advantageously, the third terminal passes through the threaded through tube and exposes the nozzle of the threaded through tube to connect to an external power source or be used to interconnect with adjacent lamps. The third terminal can be hidden at the bottom of the exhibition cabinet to avoid exposure in the cabinet and affecting the overall appearance.

Advantageously, the upright stanchion is a rod of a telescopically adjustable length. This kind of upright stanchion can make the height of the lamp body arbitrary adjustment, in order to achieve better irradiation effect, to meet the local lighting requirements of exhibits inside the cabinet.

Advantageously, the lamp body further includes a housing and a plano-convex lens, and an accommodating cavity for accommodating the light-emitting module is formed between the housing and the plano-convex lens; the housing is a cylindrical casing with a strip-shaped notch, and the inner wall surface of the strip-shaped notch of the housing has a first slot for inserting the light-emitting module and a second slot for inserting the plano-convex lens; the housing is further provided with a light shielding portion on one side of the strip-shaped notch, and the plano-convex lens has a flat light incident surface and outwardly convex curved light outgoing surface. The cylindrical shell of this lamp is small and beautiful with better visual comfort. Its end is circular arc and can be connected with the adapter flat; the plano-convex lens of the lamp has a flat light incident surface and outwardly convex curved light outgoing surface, making uniform light and good sweeping effect, reducing glare.

Compared with the prior art, the invention has the advantages that the showcase lamp of the invention includes a lamp body and a hollow upright stanchion supporting and connecting the lamp body, and the upright stanchion of the lamp can be used to support and connect lamp body, the upright stanchion in different height can be arbitrarily selected to meet the lighting requirements of cabinets of different specifications to achieve the best illumination angle and effect, reducing glare; in addition, the showcase lamp does not have a built-in power supply, its volume is more compact, and the wires used for connecting the external power supply are hidden inside the hollow upright stanchion, which avoids the direct exposure of the wires in the showcase, which improves the visual beauty of the showcase.

BRIEF DESCRIPTION OF THE DRAWINGS

The drawings described herein are intended to promote a further understanding of the present invention, as follows.

DETAILED DESCRIPTION OF THE INVENTION

The invention will be further described in detail below with reference to the embodiments of the drawings.

Figure 1:
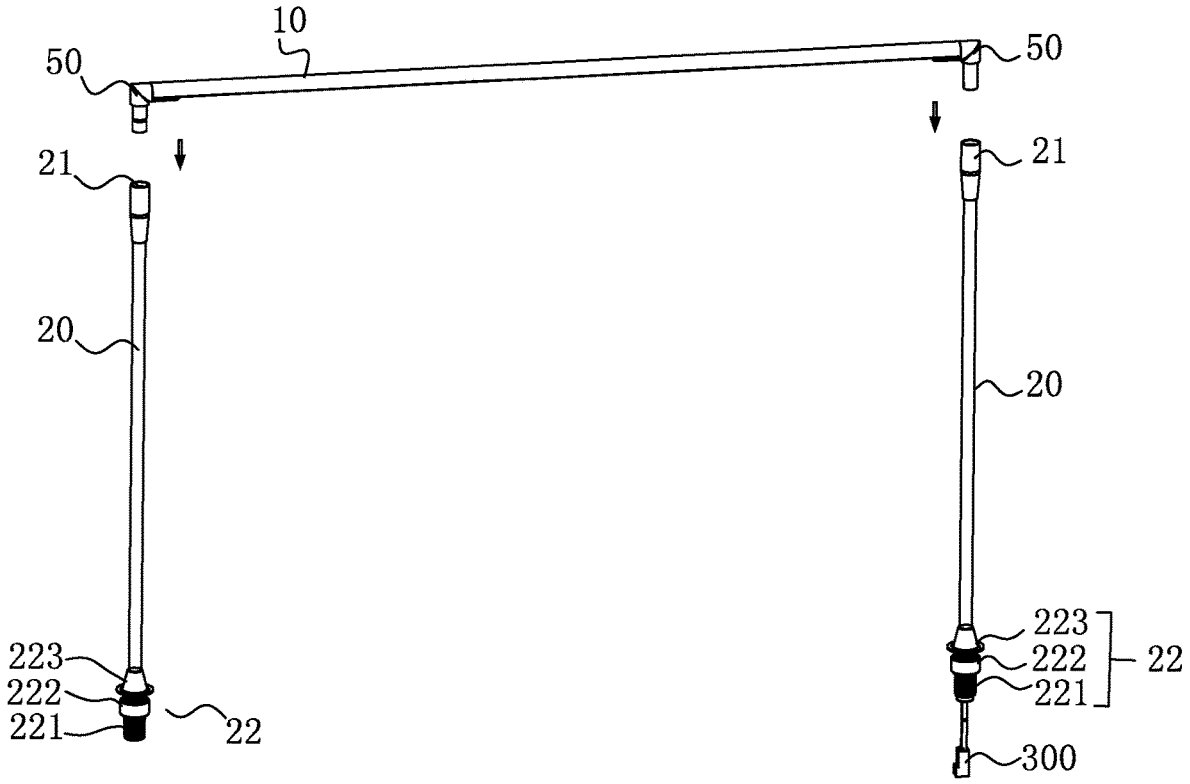
FIG. 1 is a three-dimensional structure diagram of the showcase lamps in the embodiment of the present invention.
Figure 2:
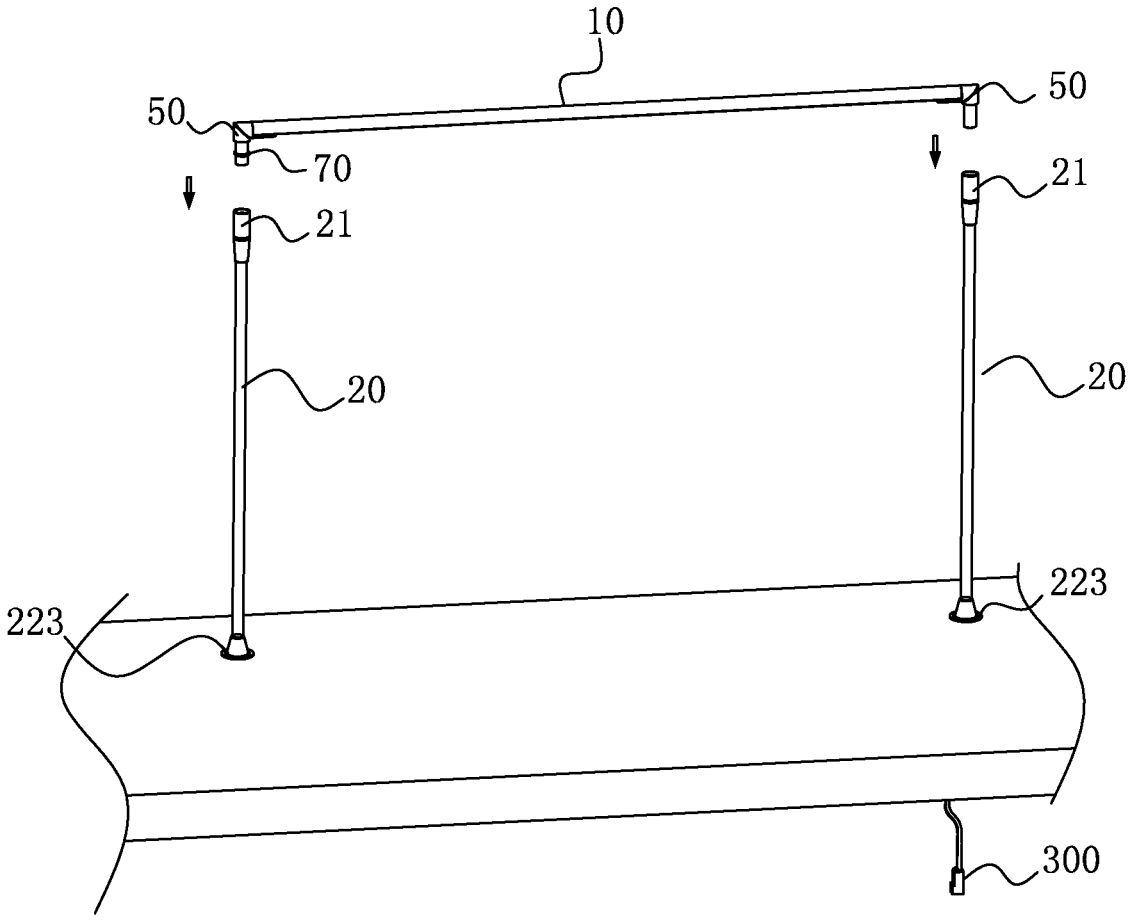
FIG. 2 is a three-dimensional structure diagram of the showcase lamps assembled in the showcase in the embodiment of the present invention.
Figure 3:
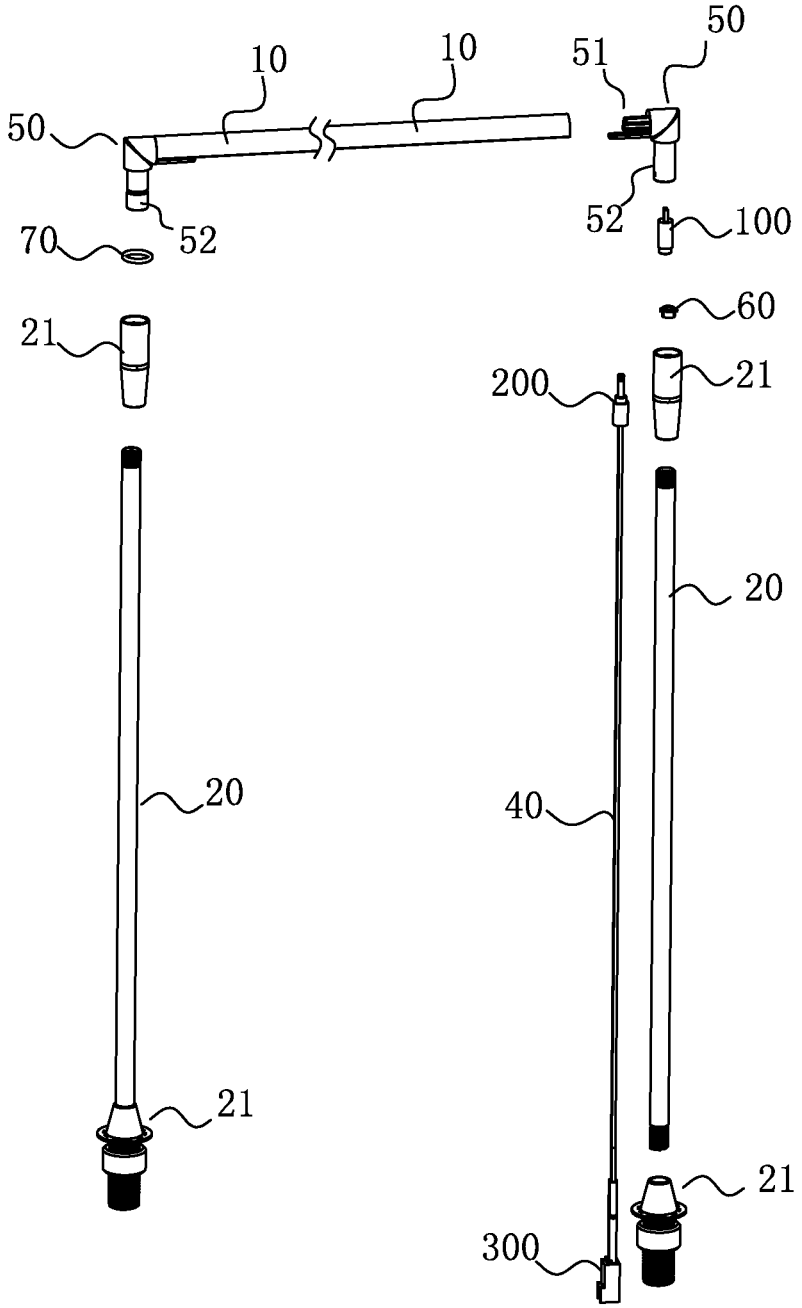
FIG. 3 is an exploded view of the showcase lamps in the embodiment of the present invention.

As shown in FIG. 1 to FIG. 3, the showcase lamp includes a lamp body 10 and at least one upright stanchion 20 for supporting the lamp body 10. In the embodiment, the lamp body 10 is elongated and the upright stanchion 20 is two. Two upright stanchions 20 are respectively supported and connected to the two ends of the lamp body 10. The upper end of the upright stanchion 20 supports the lamp body 10, and the lower end of the upright stanchion 20 can be detachably fixed on the showcase to be installed, specifically, the lamp body 10 is provided with a light-emitting module 11, and the lamp body 10 is externally provided with the first terminal 100, which is connected with the light-emitting module 11. In the embodiment, the light-emitting module 11 is an LED light-emitting board, and the first terminal 100 is disposed on one end of the light body 10. more specifically, the upright stanchion 20 is a hollow rod, and the upper end of one of the upright stanchions 20 is provided with a second terminal 200 for communicating with the first terminal 100, and the lower end of the upright stanchion 20 is provided with a third terminal 300, which is used for connecting external power supply or interconnecting with adjacent lamps, the upright stanchion 20 is built-in with wires 40 connecting the second terminal 200 and the third terminal 300. In particular, the upright stanchion 20 is adjustable in length. This kind of upright stanchion 20 can make the height of the lamp body 10 can be adjusted arbitrarily, so as to achieve better irradiation effect and meet the local lighting requirements of exhibits inside the cabinet.

Figure 4:
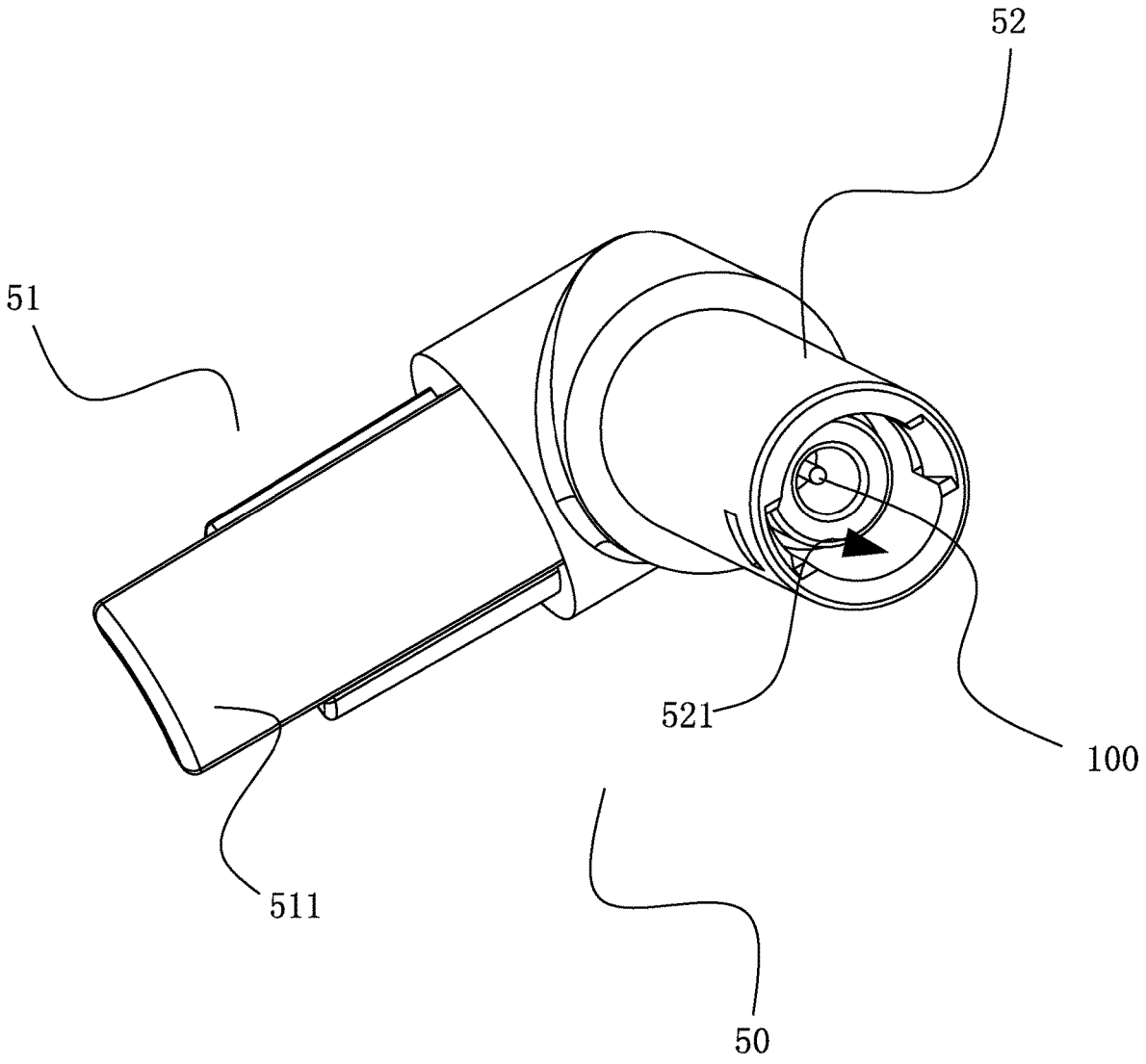
FIG. 4 is a three-dimensional structure diagram of an adapter of the showcase lamps in the embodiment of the present invention.
Figure 5:
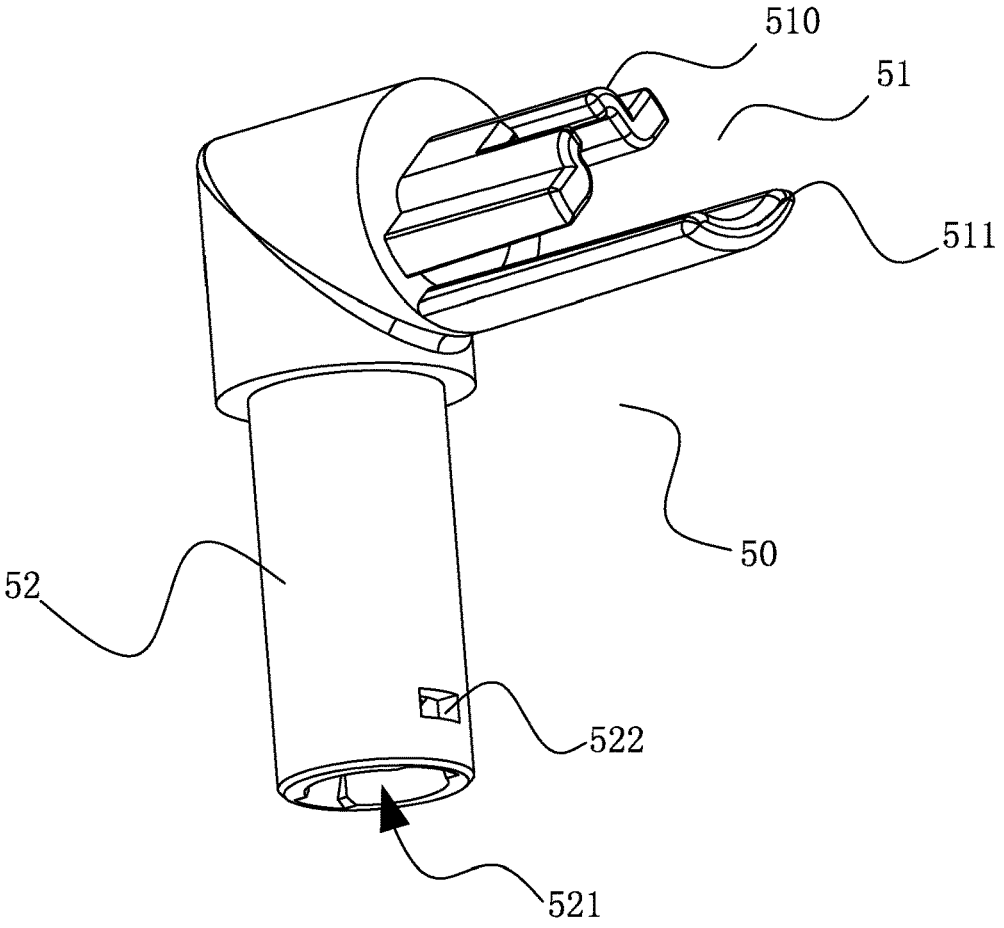
FIG. 5 is a three-dimensional structure diagram of another angle of an adapter of the showcase lamps in the embodiment of the present invention.
Figure 6:
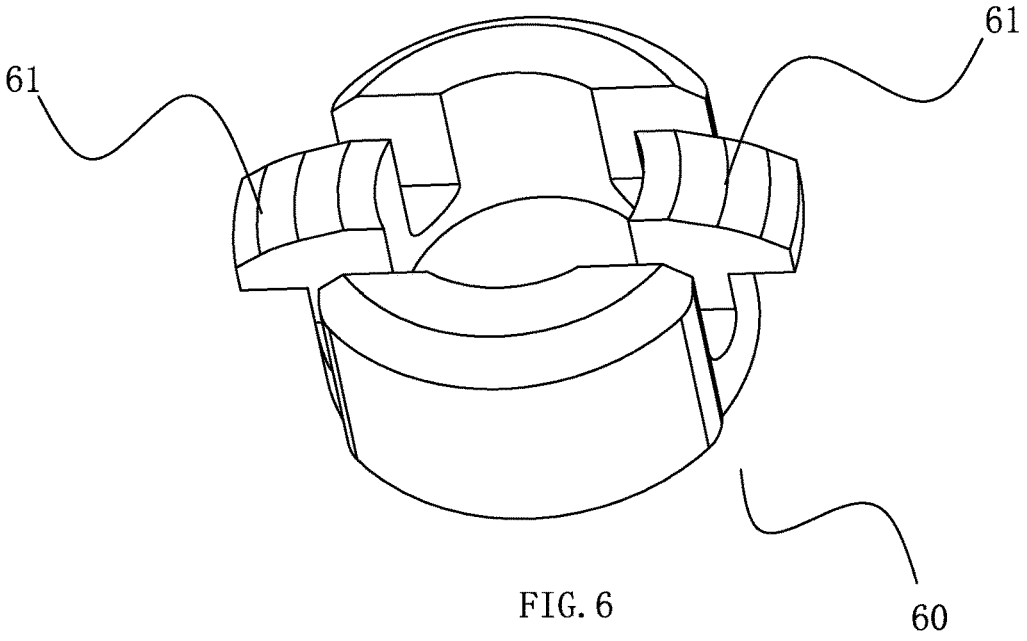
FIG. 6 is a three-dimensional structure diagram of an elastic member of the showcase lamps in the embodiment of the present invention.
Figure 7:
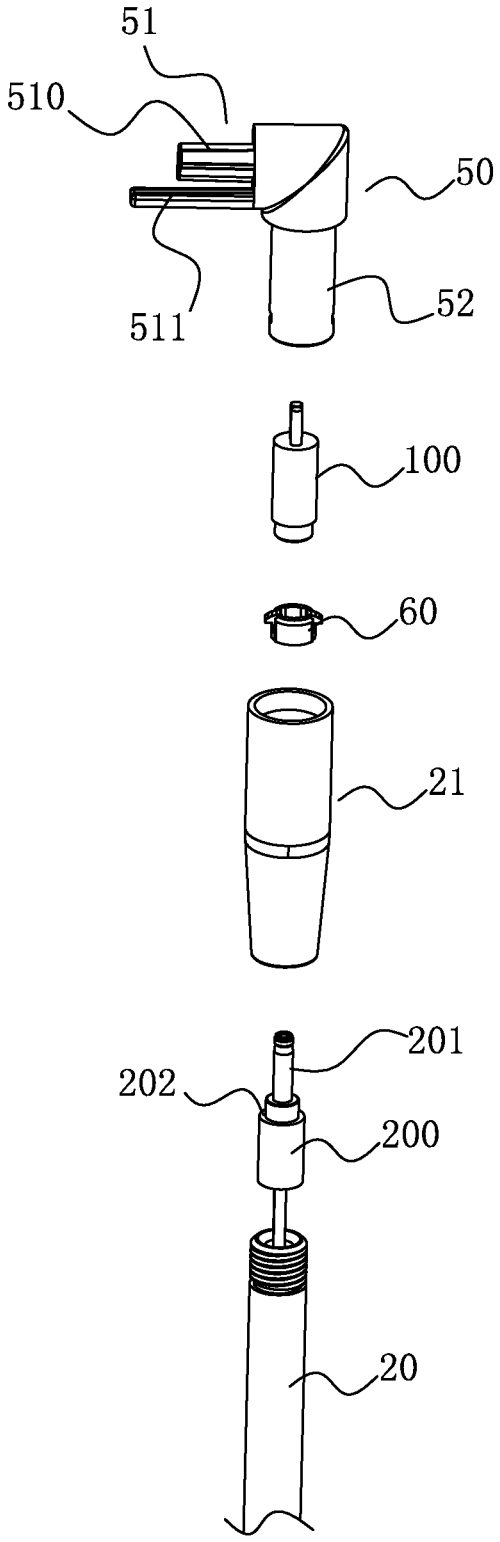
FIG. 7 is a schematic diagram of partial structural decomposition of the showcase lamps in the embodiment of the present invention.
Figure 8:
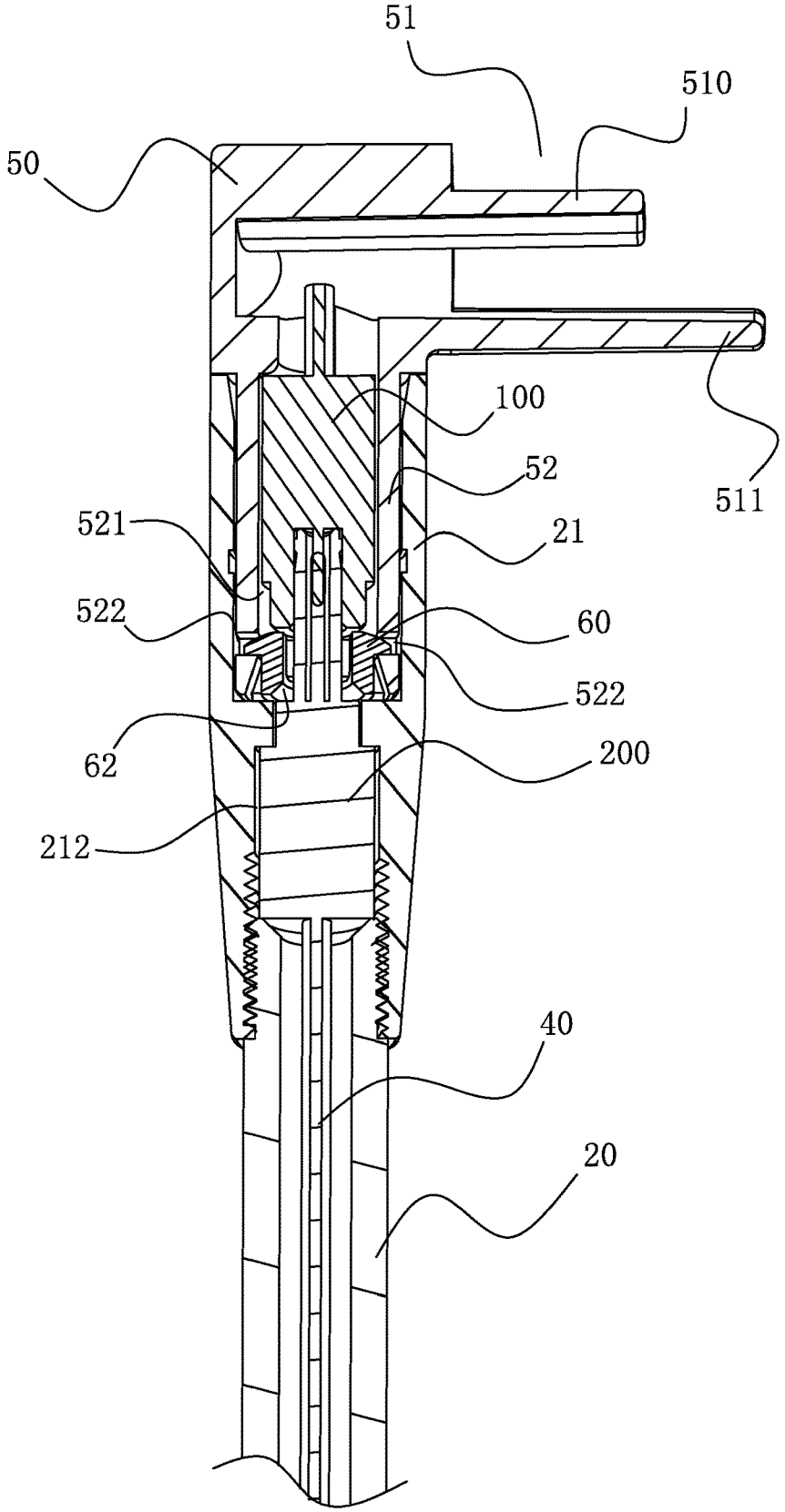
FIG. 8 is a sectional view of the adapter cooperating with the upright stanchion of the showcase lamps in the embodiment of the present invention, wherein the adapter is provided with a first terminal.
Figure 9:
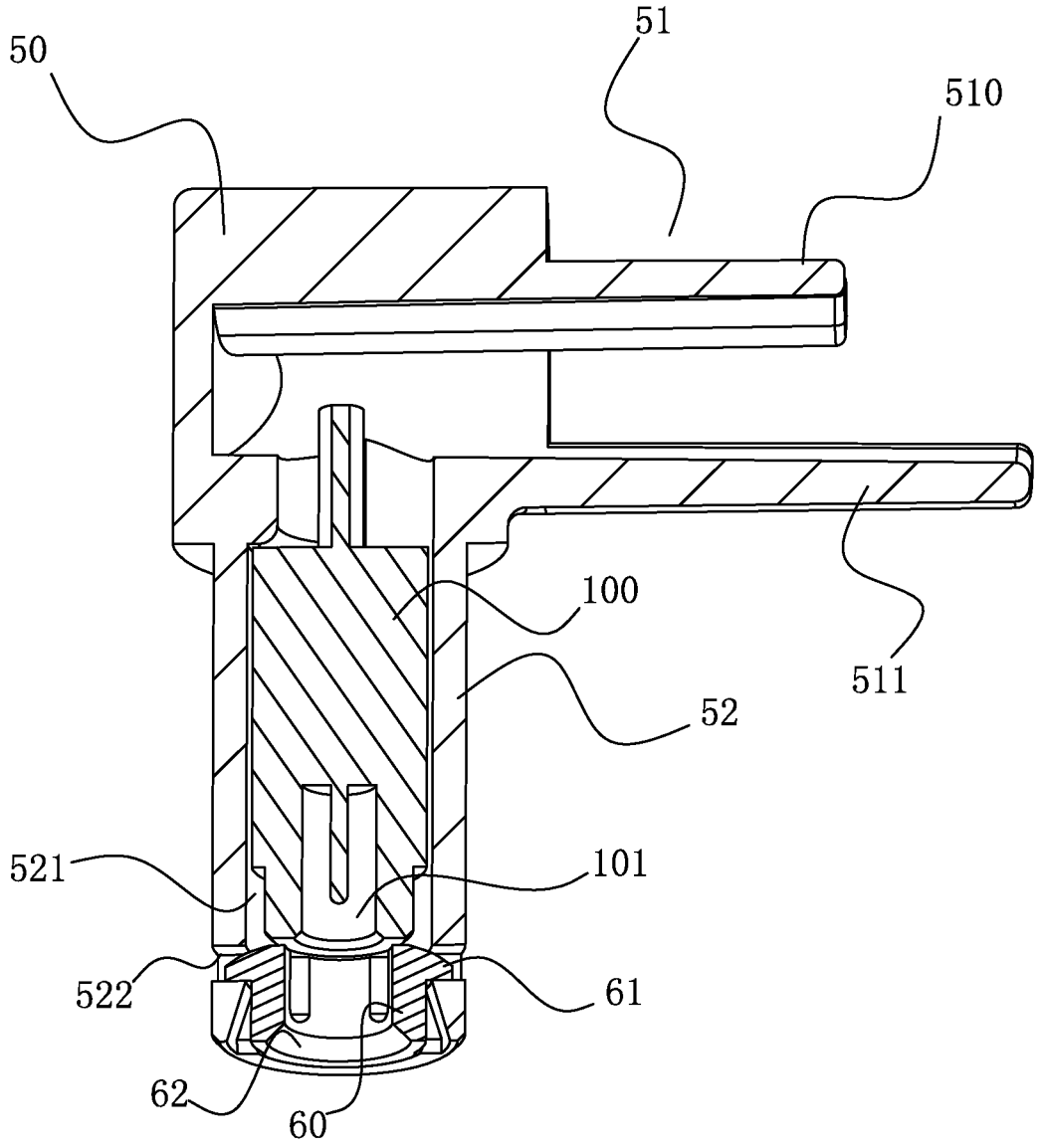
FIG. 9 is a sectional view of an adapter of the showcase lamps in the embodiment of the present invention, wherein a first terminal is disposed in the adapter.
Figure 10:
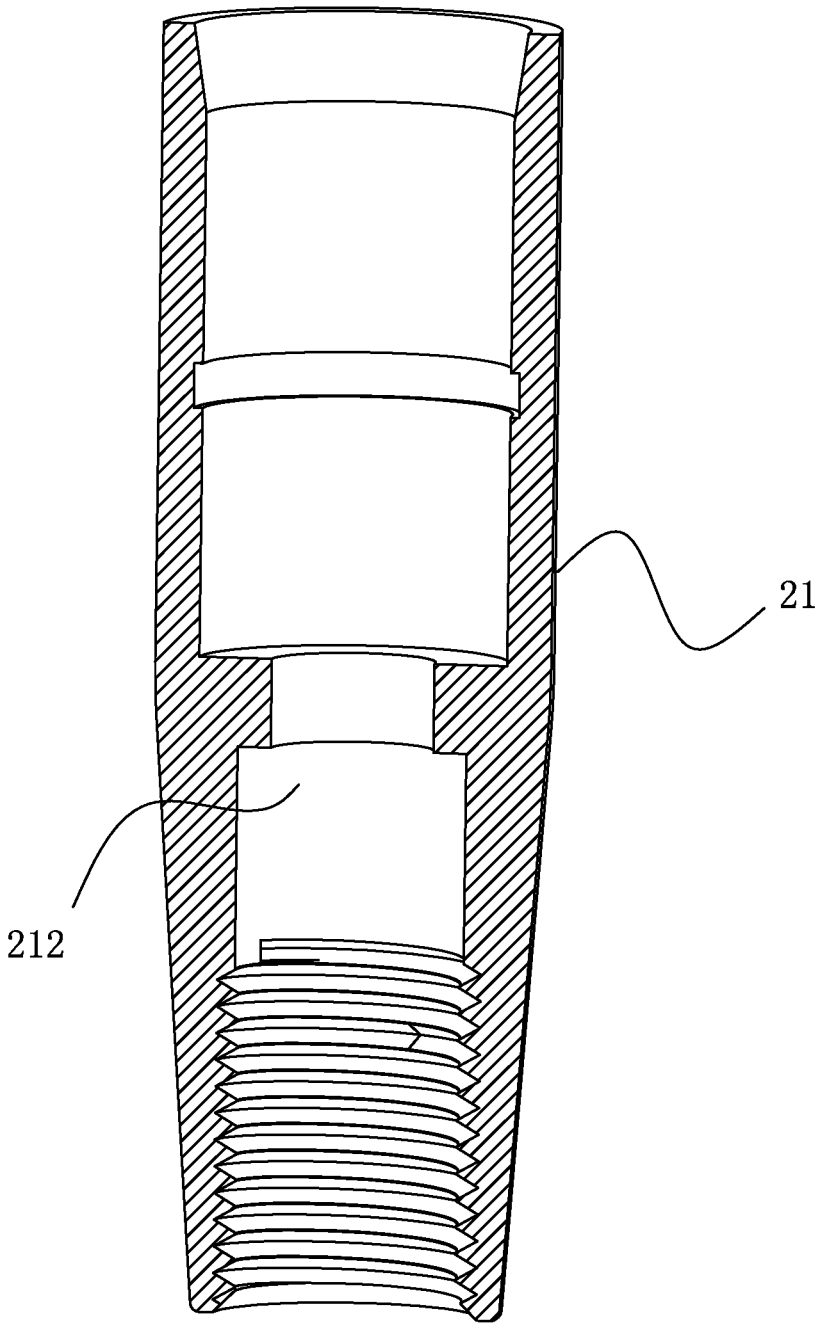
FIG. 10 is a sectional view of the sleeve of the showcase lamps in the embodiment of the present invention.
Figure 11:
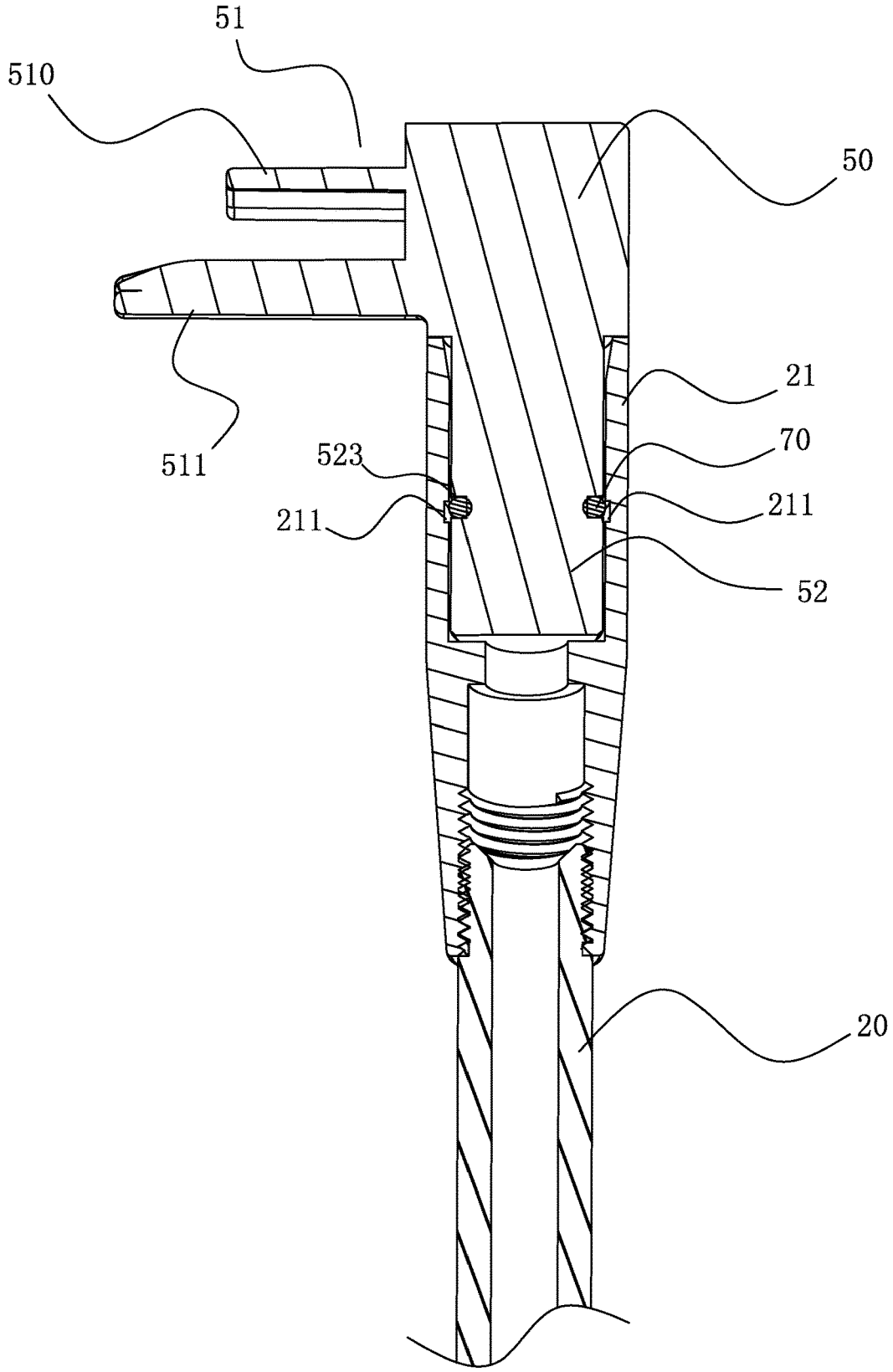
FIG. 11 is a sectional view of the adapter cooperating with the upright stanchion of the showcase lamps in the embodiment of the present invention, wherein the adapter has no first terminal.

In order to conveniently place the lamp body 10 on the upright stanchion 20 or remove it from the upright stanchion 20, the lamp body 10 is detachably mounted on the upper end of the upright stanchion 20, specifically, see FIGS. 3 to 5, in this embodiment, the two ends of the lamp body 10 are provided with adapter 50, and the adapter 50 is used for connecting the horizontally disposed lamp body 10 and the vertically disposed upright stanchion 20. The adapter 50 has a first end 51 which can be connected at the end of lamp body 10 and a second end 52 which is installed at the upper end of upright stanchion 20, where the first end 51 is set perpendicular to the second end 52. In the present embodiment, the first end 51 of adapter 50 is inserted at the end of lamp body 10. Of course, the first end 51 of the adapter 50 and the end of the lamp body 10 can also be connected by a sleeve connection, a screw connection or the like. More specifically, the upper end of the upright stanchion 20 has a sleeve 21, and the second end 52 of the adapter 50 is detachably inserted into the sleeve 21. The upper end of sleeve 21 and upright stanchion 20 is connected with thread for easy installation and disassembly. In the embodiment, the shape and size of the second end 52 of the adapter 50 are matched with the inner cavity of the sleeve 21 to prevent the lamp body 10 from loosening or shaking after installation. In addition, in order to facilitate the interpolation and connection between the first terminal 100 provided at one end of lamp body 10 and the second terminal 200 disposed at the upper end of one upright stanchions 20, in this embodiment, one of the adapters 50 at the end of the lamp body 10 is a hollow pipe fittings. The hollow pipe fitting is connected from the first end 51 through to the second end 52, and the first terminal 100 is fixed in the tube cavity 521 of the second end 52 of the adapter 50, the wiring of the light-emitting module 11, which is connected to the inside of the lamp body 10, passes through the adapter 50 to connect the first terminal 100. Correspondingly, the sleeve 21 of one of the upright stanchions 20 is provided with the second terminal 200. In the embodiment, the first terminal 100 and the second terminal 200 can be connected by conventional plug and socket structure. Specifically, the first terminal 100 can move with the adapter 50 and plug into and connect the second terminal 200, when the lamp body 10 is installed on the upper end of upright stanchions 20, the first terminal 100 is connected with the second terminal 200; when the lamp body 10 disengages from the upper end of the upright stanchions 20, the first terminal 100 is disconnected from the second terminal 200. The lamp body 10 and the upright stanchion 20 of the showcase lamp adopt the mode of sleeve 21 and adapter 50 inserting and matching. The structure of the upright stanchion 20 and sleeve 21 can not only effectively support and connect the lamp body 10, but also has a simple structure, which is convenient to place and remove the lamp body 10. In addition, the first terminal 100 of the built-in adapter 50 can be accurately inserted and connected with the second terminal 200 accommodated in sleeve 21. Referring to FIG. 3 and FIG. 11, in the embodiment, the adapter 50 connected to the other end of the lamp body 10 is of a solid structure, that is, the adapter 50 is not a hollow structure, and is not used for wiring, and the outer wall surface of the second end 52 has an annular groove 523 for arranging the rubber ring 70. The rubber ring 70 sleeved on the second end 52 of the adapter 50 slightly exposes the outer wall surface of the second end 52. Accordingly, the inner wall surface of sleeve 21 is provided with a concave annular positioning groove 211 correspondingly the corresponding position of the rubber ring. The second end 52 of the adapter 50 is inserted into the sleeve 21. The rubber ring sleeved on the second end 52 of the adapter 50 can be inserted into the positioning groove 211 of the sleeve 21. on one hand the structure is arranged to enable the lamp body 10 to be fixedly placed on the upper end of the upright stanchions 20 to avoid loosening or shaking, and on the other hand, the lamp body 10 connected with the adapter 50 can be easily removed from the sleeve 21 at the upper end of the upright stanchions 20 due to the elastic deformation of rubber ring 70. Of course, the two upright stanchions 20 for supporting and connecting the lamp body 10 can be used to draw out the wires. Accordingly, both ends of the lamp body 10 are matched with the upright stanchions 20 by using the adapter 50 having a hollow structure, so as to realize the interconnection between the showcase lamps and the adjacent lamps.

Referring to FIG. 7 to FIG. 10, in the process of placing the lamp body 10 on the sleeve 21 of the upright stanchions 20, in order to enable accurate insertion and cooperation of the first terminal 100 and the second terminal 200, in this embodiment, the first terminal 100 and the second terminal 200 are connected by plugs and jacks. The first terminal 100 is a jack part, and the jack part is disposed in the tube cavity 521 of the second end 52 of the adapter 50. The jack part is a cylinder having an electrode insertion hole 101, and it can fit the size of the tube cavity 521 of the second end 52, specifically, the jack part and the tube cavity 521 are coaxially set, the jack part can be loaded from the port of the second end 52 of the adapter 50 and the jack part is fixed in the tube cavity 521 of the second end 52 through the elastic member 60 embedded in the port. Correspondingly, the second terminal 200 is a plug part, and the plug part is disposed in the sleeve 21. Specifically, the plug part is a cylinder with pin 201 protruding in the center, and the plug part has a step portion 202, the inner wall of the sleeve 21 is formed with a stepped hole 212 adapted to the step portion 202 of the plug part, the plug part can be limited in the stepped hole 212, the sleeve 21 can be screwed with the upper end of the upright stanchions 20, and the plug part is clamped and fixed in the sleeve 21. The clamped plug part is coaxial with the sleeve 21. Moreover, it facilitates accurate mating engagement with the jack part fixed in the tube cavity 521 of the second end 52 of the adapter 50. Referring to FIG. 6 to FIG. 9, the elastic member 60 is an annular part having an elastic buckle 61. The plug part can be inserted into the jack part through the annular part, wherein the elastic buckle 61 is two, respectively located on opposite sides of the annular part. Correspondingly, the end wall of the second end 52 of the adapter 50 is provided with two penetrating bayonets 522. When the elastic member 60 is embedded into the port of the second end 52, the elastic buckle 61 can be clamped at the bayonet 522, the jack part is further fixed in the tube cavity 521 of the second end 52. Further, the elastic member 60 with annular structure toward a peripheral edge of the plug part is further formed with a chamfer 62. The chamfer 62 is provided to facilitate the smooth insertion of the plug part into the jack part. It will of course be appreciated by those skilled in the art that the first terminal 100 can also be a plug part, the second terminal 200 can be a jack part that is adapted thereto, or both can employ other conventional forms of electrode inserts.

Referring to FIGS. 2 to 3, in order to conveniently fix the upright stanchions 20 in the showcase, the lower end of the upright stanchions 20 has a detachable clamping member 22, specifically, the clamping member 22 and the lower end of the upright stanchions 20 are threaded connection, referring to FIG. 3, the clamping member 22 includes a threaded through tube 221 with external thread and a precession nut 222 sleeved on the threaded through tube 221. The threaded through 221 is provided with a resisting portion 223 which clamping fits the precession nut 222. The structural arrangement is such that the upright stanchions 20 can be stably fixed on the bottom plate of the showcase. During installation, just pass the threaded through tube 221 through the installation hole (not shown) on the floor plate of the showcase, and tighten the precession nut 222 to complete the fixed installation. The installation method is simple and convenient, and only needs to set corresponding mounting holes in different positions in the showcase, and then after installing the showcase lamps, the lighting requirements of different areas in the showcase can be realized, which is more convenient and flexible. In addition, referring to FIG. 1, the third terminal 300 passes through the threaded through tube 221 and exposes the nozzle of the threaded through tube 221 to communicate with an external power source or for interconnection with an adjacent lamp, in this embodiment, the third terminal 300 is hidden at the bottom of the showcase, avoiding exposure to the cabinet and affecting the overall appearance of the showcase.

Figure 12:
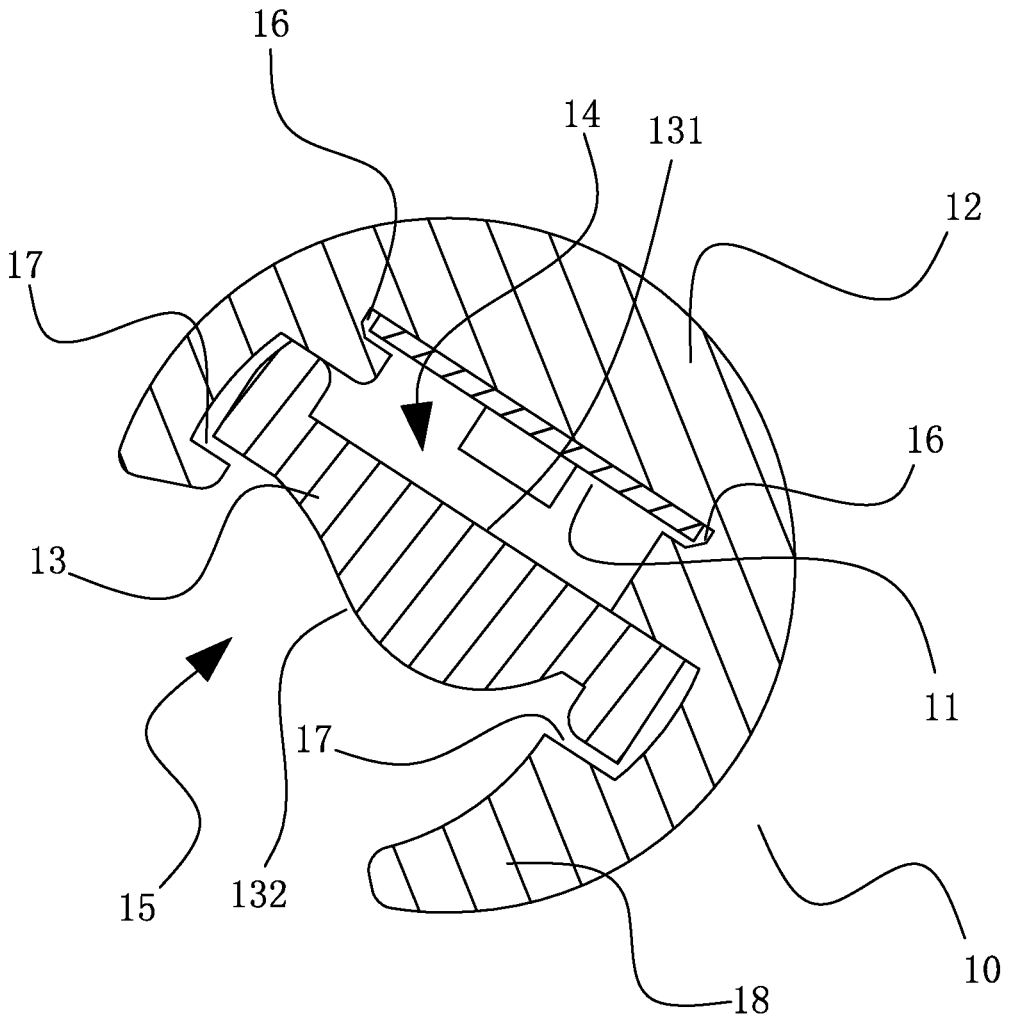
FIG. 12 is a transverse cross-sectional view of a lamp body of the showcase lamps in the embodiment of the present invention.
Figure 13:
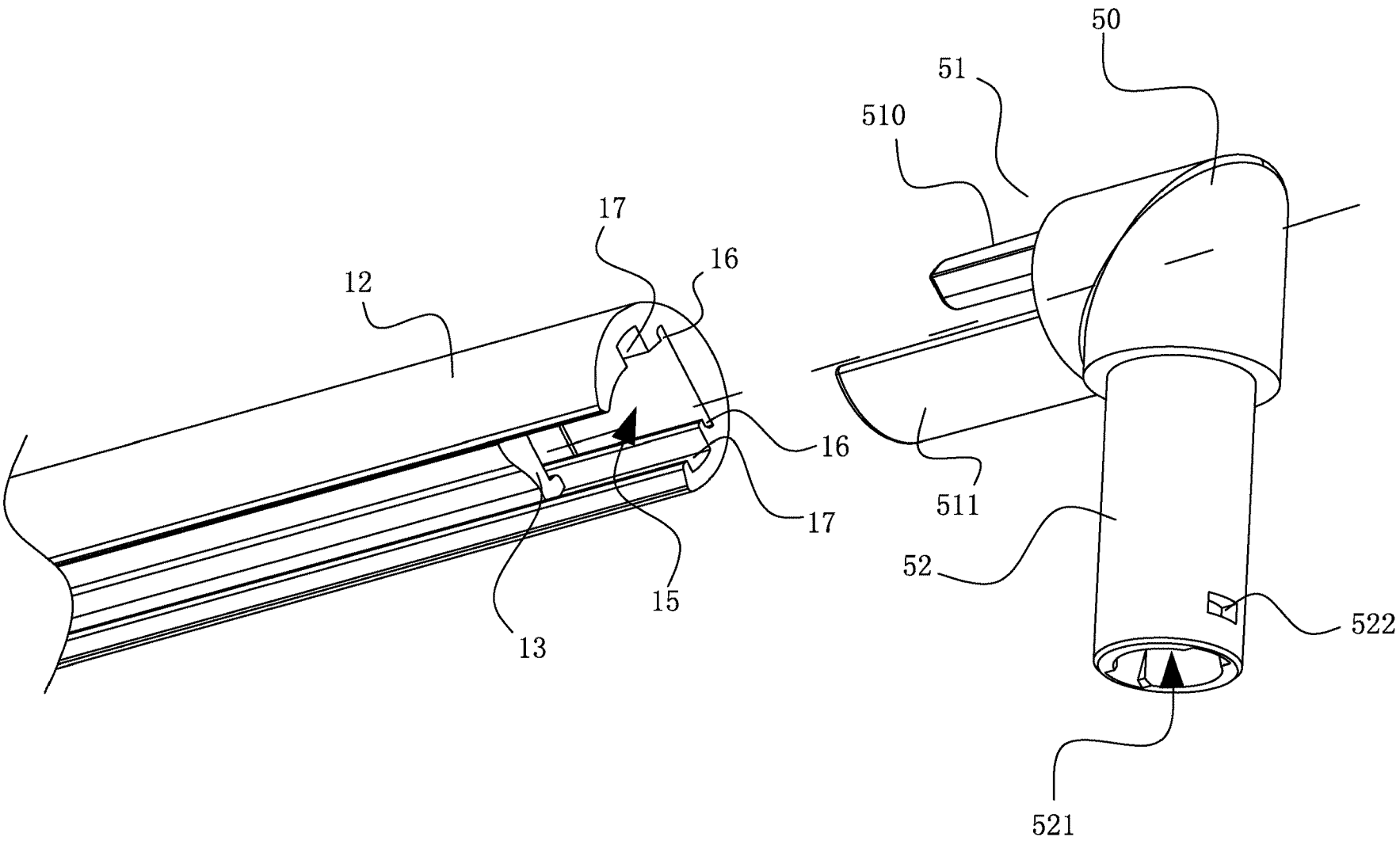
FIG. 13 is a decomposition diagram of a lamp body and an adapter of the showcase lamps in the embodiment of the present invention.
Figure 14:
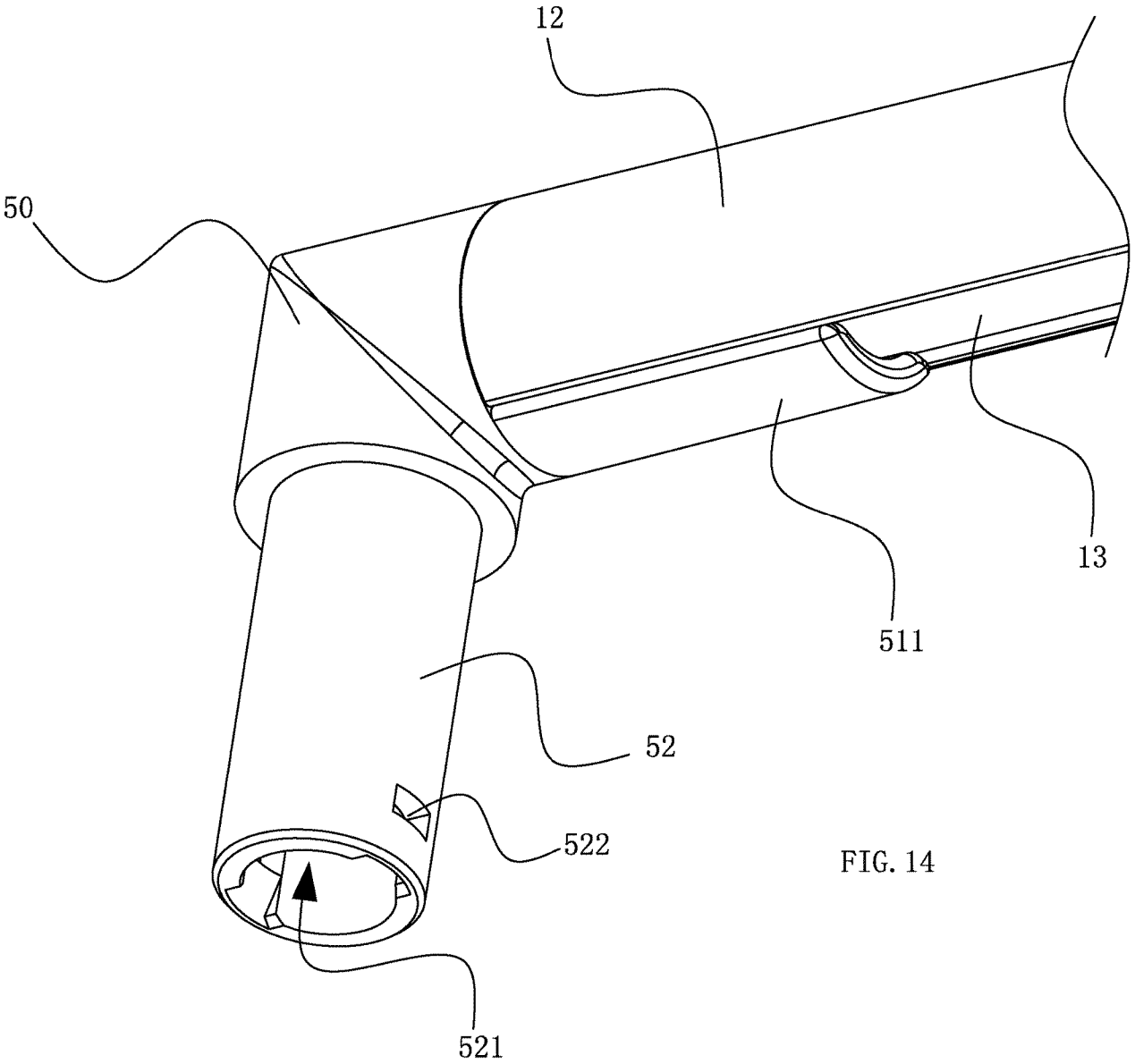
FIG. 14 is a three-dimensional structure diagram of the assembled structure of the lamp body and the adapter of the showcase lamps in the embodiment of the present invention.

Referring to FIG. 12 to FIG. 14, in order to solve the glare problem of the lamp in the showcase and make it have uniform sweeping effect, in this embodiment, the lamp body 10 includes a housing 12, a light-emitting module 11 and a plano-convex lens 13, specifically, the light-emitting module 11 can be an LED light-emitting board, and the accommodating cavity 14 for accommodating the LED light-emitting board is formed between the housing 12 and the plano-convex lens 13. Specifically, referring to FIG. 13, the housing 12 of the lamp body 10 is a cylindrical housing with a strip-shaped notch 15 which is small in size and has a higher degree of matching and better visual comfort when connected to the same cylindrical (tube) shaped the adapter 50 and the upright stanchions 20. Specifically, the housing 12 can be extruded from aluminum or other plastic materials; in the embodiment, the inner wall surface of the strip-shaped notch 15 of the housing 12 has a first slot 16 for inserting the LED light-emitting panel and a second slot 17 for inserting the plano-convex lens 13, wherein the first slot 16 and the second slot 17 are strip-shaped slots disposed along the length direction of the housing 12. In the embodiment, the length of the plano-convex lens 13 is slightly smaller than that of the housing 12, so that after the plano-convex lens 13 is inserted into the second slot 17 of housing 12, the second slot 17 at the end of the housing 12 still has excess space for insertion of the first end 51 of the adapter 50. Accordingly, see FIG. 5 and FIG. 13, the first end 51 of the adapter 50 has a strip-shaped insert 510 that can be inserted into the second slot 17 and is adapted to the second slot 17. The adapter 50 is connected to the end of the lamp body 10 via the strip-shaped insert 510. Specifically, see FIG. 14, after the adapter 50 is connected to the lamp body 10, the outer wall surfaces of the two can be smoothly transition connected to increase the overall aesthetic of the lamps. Further, the first end 51 of the adapter 50 further has a curved plate 511, the curved plate 511 can be embedded in one end of the strip-shaped notch 15 of the cylindrical casing and has the same radian as the cylindrical casing, and then spliced with the cylindrical casing to form a smooth cylindrical outer wall surface, thereby increasing aesthetics. In addition, referring to FIG. 12, the plano-convex lens 13 has a flat light incident surface 131 and an outwardly convex curved light outgoing surface 132. This kind of lens produces uniform light, has good sweeping effect, reduces glare, and has better visual comfort. The housing 12 is further provided with a light shielding portion 18 on one side of the strip-shaped notch 15, that is, the light shielding portion 18 is disposed on one side of the strip-shaped notch 15 along the length direction of the housing 12, and the light shielding portion 18 can reduce some light scattering out of the showcase and avoid visual fatigue caused by lighting and human eyes.

The upright stanchions 20 of the showcase lamp in this embodiment can not only support and connect the lamp body 10, but also enable the wires 40 used for connecting external power or connecting with adjacent lamps to be hidden in the inner cavity of the upright stanchion 20 and lead out from the bottom of the upright stanchion 20, which avoids the wires 40 directly exposed in the showcase, thereby improving the visual beauty of the showcase. Secondly, the lamp body 10 of the showcase lamp is detachably connected with the upright stanchion 20, on one hand, this kind of split structure is convenient for disassembly and assembly, and the space occupation is small, which is convenient for packaging and transportation. On the other hand, when this kind of the lamp is used in the showcase, the lamp body 10 can be conveniently placed on the upright stanchion 20 or removed from the upright stanchion 20, and it's quick and convenient to replace the lamp body 10; in addition, in the process of placing the lamp body 10 on the sleeve 21 of the upright stanchion 20, the lamp can realize the accurately inserting and matching between the first terminal 100 and the second terminal 200, ensuring the effective contact between the two terminals; finally, the height of the upright stanchion 20 of the showcase lamp can be arbitrarily selected to meet the lighting requirements of different specifications of the cabinet, to achieve the best illumination angle and effect, to reduce glare. Moreover, the showcase lamp are equipped with plano-convex lens 13, which gives uniform light, has good sweeping effect, reduces glare and provides better visual comfort.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

What is claimed is:

1. A showcase lamp comprising:

a lamp body (10) having a light-emitting module (11) therein, and the lamp body (10) is externally provided with a first terminal (100) draw out from the light-emitting module (11); and at least one upright stanchion (20), the upper end of the upright stanchion (20) supports the lamp body (10), and the lower end of the upright stanchion (20) can be detachably fixed on the showcase to be installed;

wherein the upright stanchion (20) is a hollow rod, and the upper end of the at least one upright stanchion (20) is provided with a second terminal (200) for communicating with the first terminal (100), and the lower end of the upright stanchion (20) is provided with a third terminal (300) for connecting external power supply or for interconnecting with adjacent lamps, the upright stanchion (20) is built-in with wires (40) connecting the second terminal (200) and the third terminal (300); wherein, the lower end of the upright stanchions (20) has a clamping member (22) for fastening the upright stanchions (20) to the showcase to be mounted;

the clamping member (22) includes a threaded through tube (221) with external thread and a precession nut (222) sleeved on the threaded through tube (221), and the threaded through tube (221) is provided with a resisting portion (223) which clamping fits the precession nut (222).

2. The showcase lamp as claimed in claim 1, wherein the lamp body (10) is detachably mounted on the upper end of the upright stanchions (20);

when the lamp body (10) is mounted to the upper end of the upright stanchions (20), the first terminal (100) is in communication with the second terminal (200);

when the lamp body (10) is disengaged from the upper end of the upright stanchions (20), the first terminal (100) is disconnected from the second terminal (200).

3. The showcase lamp as claimed in claim 2, wherein the lamp body (10) has an elongated shape, and the first terminal (100) is drawn from at least one end of the lamp body (10); the upright stanchions (20) are two, respectively supported and connected at both ends of the lamp body (10).

4. The showcase lamp as claimed in claim 3, wherein the showcase lamp further comprising an adapter (50) for connecting the lamp body (10) and the upright stanchions (20), the adapter (50) having a first end (51) connectable to an end of the lamp body (10), and a second end (52) mounted on the upper end of the upright stanchions (20);

the upper end of the upright stanchions stanchion (20) has a sleeve (21), and the second end (52) of the adapter (50) is detachably inserted into the sleeve (21).

5. The showcase lamp as claimed in claim 4, wherein the at least one adapter (50) is a hollow pipe fittings connected from the first end (51) through to the second end (52), and the first terminal (100) is disposed in the tube cavity (521) of the second ends (52) of the adapter (50), the wiring of the light-emitting module (11), which is connected to the inside of the lamp body (10), passes through the tube cavity (521) to connect the first terminal (100);

the sleeve (21) of the at least one upright stanchion (20) is provided with the second terminal (200), and correspondingly, the first terminal (100) can move with the adapter (50) and plug into and connect the second terminal (200).

6. The showcase lamp as claimed in claim 5, wherein the first end (51) of the adapter (50) is arranged perpendicular to the second end (52).

7. The showcase lamp as claimed in claim 1, wherein the third terminal (300) passes through the threaded through tube (221) and exposes the nozzle of the threaded through tube (221) to connect to an external power source or be used to interconnect with adjacent lamps.

8. The showcase lamp as claimed in claim 1, wherein the upright stanchion (20) is a rod of a telescopically adjustable length.

9. The showcase lamp as claimed in claim 8, wherein the lamp body (10) further includes a housing (12) and a plano-convex lens (13), and a accommodating cavity (14) for accommodating the light-emitting module (11) is formed between the housing (12) and the plano-convex lens (13);

the housing (12) is a cylindrical casing with a strip-shaped notch (15), and the inner wall surface of the strip-shaped notch (15) of the housing (12) has a first slot (16) for inserting the light-emitting module (11) and a second slot (17) for inserting the plano-convex lens (13);

the housing (12) is further provided with a light shielding portion (18) on one side of the strip-shaped notch (15), and the plano-convex lens (13) has a flat light incident surface (131) and outwardly convex curved light outgoing surface (132).

10. The showcase lamp as claimed in claim 2, wherein the upright stanchion (20) is a rod of a telescopically adjustable length.

* * * * *